US006695408B1

(12) United States Patent
Nobbe

(10) Patent No.: US 6,695,408 B1
(45) Date of Patent: Feb. 24, 2004

(54) CHAIR KIT WITH LACED SUPPORT

(76) Inventor: Paul J. Nobbe, 11177 U.S. Hwy. 52, Brookville, IN (US) 47012

( * ) Notice: Subject to any disclaimer, the term of this patent is extended or adjusted under 35 U.S.C. 154(b) by 0 days.

(21) Appl. No.: 10/274,774

(22) Filed: Oct. 21, 2002

(51) Int. Cl.[7] ..... A47C 7/16

(52) U.S. Cl. ..... 297/440.11; 297/440.16; 297/440.18; 297/228.12; 297/440.23

(58) Field of Search ..... 297/440.1, 440.11, 297/440.15, 440.16, 440.23, 440.24, 440.21, 228.1, 228.11, 228.12

(56) References Cited

U.S. PATENT DOCUMENTS 488,095 A * 12/1892 Scott et al. ..... 297/440.24 X
1,650,697 A * 11/1927 Frehn ..... 297/440.1
3,115,367 A * 12/1963 Gariepy ..... 297/440.1
4,146,269 A * 3/1979 Beckley ..... 297/440.18
4,738,383 A * 4/1988 Dearborn et al. ..... 224/155
5,536,063 A * 7/1996 Cable ..... 297/440.16
5,704,682 A * 1/1998 Gorayeb et al. .... 297/440.11 X

* cited by examiner

*Primary Examiner*—Anthony D. Barfield
(74) *Attorney, Agent, or Firm*—Woodard, Emhardt, Moriarty, McNett & Henry LLP

(57) ABSTRACT

A chair and kit for producing a kit. A plurality of legs and cross-members are connectable together to form a chair frame. A leather seat portion and back portion are mounted to the frame and secured together by lacing extending through the opposed ends of the back and seat portion.

11 Claims, 6 Drawing Sheets

CHAIR KIT WITH LACED SUPPORT

BACKGROUND OF THE INVENTION

1. Field of the Invention

The present invention relates generally to the field of furniture and more specifically kits for assembling a chair.

2. Description of the Prior Art

In order to minimize the cost of furniture, such as chairs, it is desirable to produce a kit that may be assembled by the purchaser thereby eliminating assembly cost. In the case of wooden chairs, a kit can be produced by providing a plurality of wooden poles that may be assembled into final form. Nevertheless, attachment of the seat and back to the wooden frame in a secure manner is difficult due to the upholstery industry technique of stitching together the fabric as it is extended around the wooden frame. What is needed is a technique for attaching the fabric that is exceptionally simple to practice by anyone and without requiring knowledge of upholstery procedures. Such a kit can be sold by mail order and over the World Wide Web allowing the purchaser to produce a high quality finished product at relatively low cost. Disclosed herein is such a kit.

SUMMARY OF THE INVENTION

One embodiment of the present invention is a kit for making a chair comprising a plurality of wooden members having sockets and reduced diameter ends to fixedly fasten in the sockets to fit together forming legs, arms, a back support portion and a seat support portion. A first flexible cross-shaped sheet has a first pair of oppositely directed and mutually facing extensions forming a first portion and a second portion and a second pair of opposite directed and mutually facing extensions transverse to the first pair. The first pair and the second pair are mountable to and are extendable around certain of the wooden members. A first lace extends through the first pair to draw together the first pair of extensions. The first portion has a first row of holes and the second portion has a second row of holes. The first lace is extendable alternatively through a hole in the first row and then through a hole in the second row in shoelace fashion. A second lace extends through the second pair to draw together the second pair of extensions.

Another embodiment of the present invention is a chair comprising a plurality of wooden poles connected together forming a chair frame having a seat and a back. A first leather sheet is mounted to the poles with the sheet having a first pair of opposite ends. A first lace extends through and fastens together the ends securing the leather sheet to the poles.

It is an object of the present invention to provide a kit for making a chair that allows easy assembly of the wooden frame and attachment of the seat and back thereto.

A further object of the present invention is to provide a chair having a wooden frame with a seat and back attached to the frame by means of lacing.

A further object of the present invention is to provide a kit for producing a chair thereby reducing assembly cost while allowing a shipment of the kit in an unassembled condition.

Related objects and advantages will be apparent from the following description.

DESCRIPTION OF THE PREFERRED EMBODIMENT

Figure 1:
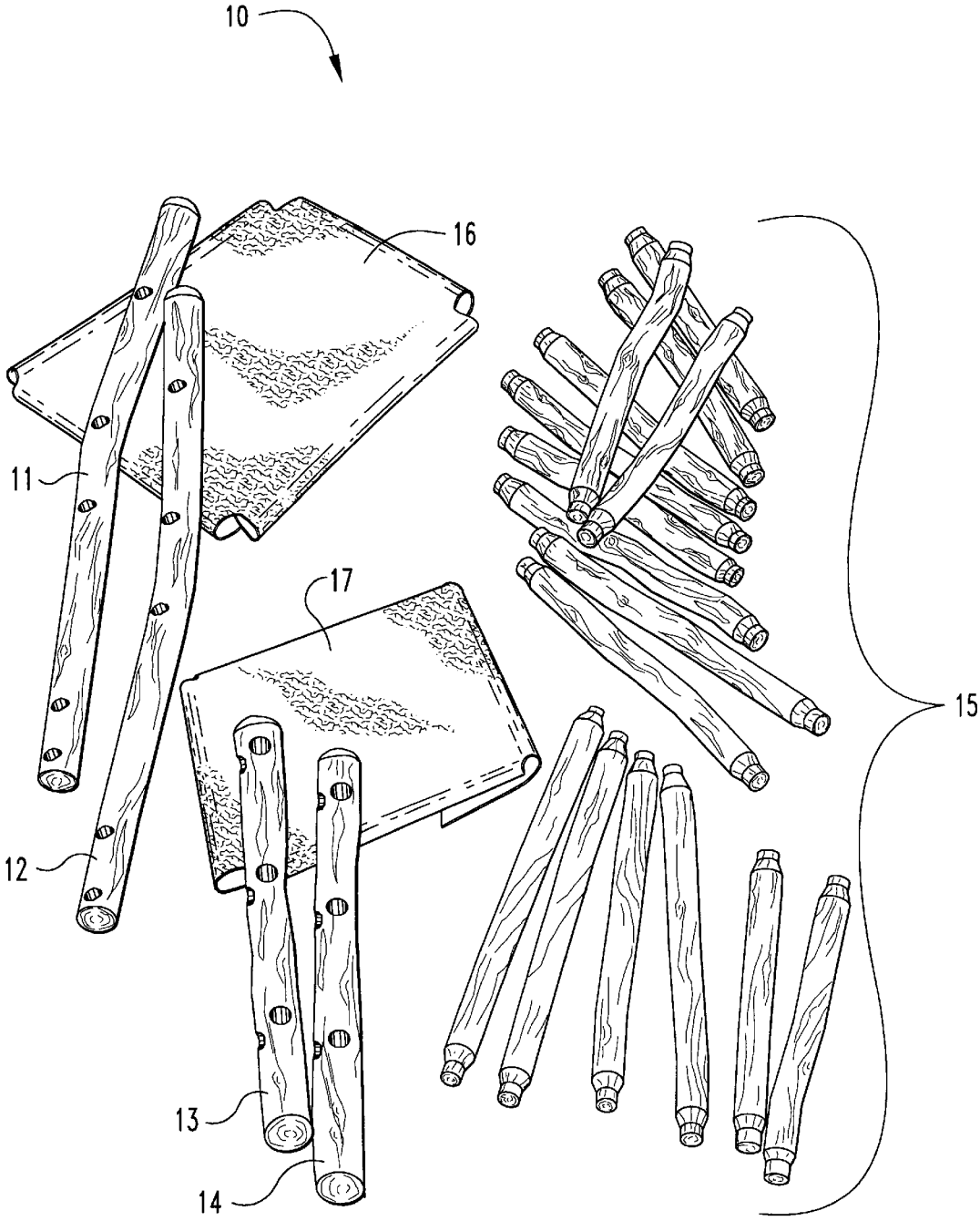
FIG. 1 is a view of the kit to produce the assembled chair of FIG. 2.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
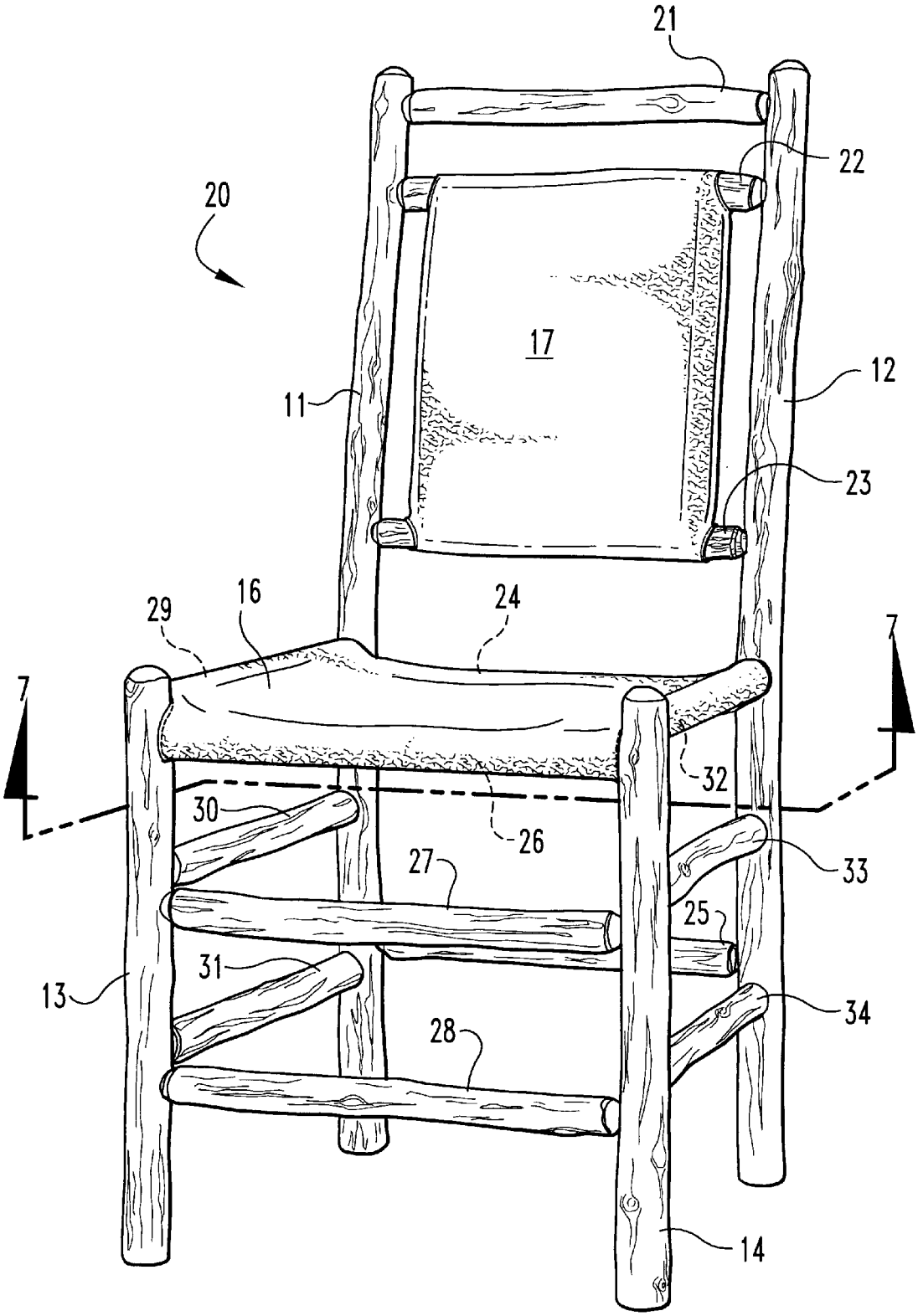
FIG. 2 is a front perspective view of a chair assembled from the kit of FIG. 1.

Referring to FIG. 1, there is shown the various components to produce the chair of FIG. 2. Kit 10 includes a pair of rear legs 11 and 12, a pair of front legs 13 and 14 and sixteen poles 15. Legs 11–14 and poles 15 may be produced from wood and in the preferred embodiment are produced from hickory. The legs and poles must be properly harvested, cut and processed in order to eliminate damage by beetles and to prevent the bark from separating from the wood thereby providing an authentic appearance. Likewise, the rear legs may be bent or formed to allow the back portion to extend slightly rearwardly. Techniques to accomplish the processing and bending are disclosed in my prior U.S. Pat. Nos. 5,183,091 and 5,297,602. Kit 10 further includes a seat portion 16 and back portion 17 produced from leather that are assembled and thereby attached to the wooden frame produced from legs 11–14 and poles 15.

Legs 11–14 are provided with sockets to receive the reduced diameter ends of the various poles 15. The ends may be inserted into the sockets and suitable commercial adhesive used to prevent disengagement therefrom. Shown in FIG. 2 is a chair produced from the kit of FIG. 1; however, it is to be understood that the kit may be utilized to form a variety of different types of chairs including a rocking chair with the legs and poles being arranged to produce the final configuration.

Chair 20 includes the pair of rear legs 11 and 12 spaced apart and secured together by five horizontally extending rear cross members 21–25 that are included within the set of poles 15. Each leg 11 and 12 extend vertically upward from the bottom of the chair and then extend slightly rearwardly thereby tilting back portion 17 in a rearward direction to provide a more comfortable chair. Thus, each leg 11 and 12 is bowed although such is not necessary to practice the present invention but simply provides a more comfortable chair. Legs 11 and 12 have mutually opposed sockets arranged to receive the opposite reduced diameter ends of cross members 21–25.

The front legs 13 and 14 extend vertically upward from the bottom of the chair and have mutually opposed sockets to receive the reduced diameter ends of front cross members 26–28. Front leg 13 and the bottom portion of leg 11 have mutually opposed sockets to receive the reduced diameter ends of side cross-members 29–31 whereas front leg 14 and the bottom portion of leg 12 have mutually opposed sockets to receive the reduced diameter ends of side cross members 32–34.

Members 21–34 are included within the set of poles 15. In the preferred embodiment, members 21–25 each have an approximate length of 14 inches, members 29–34 each have an approximate length of 15 inches and members 26–28 each have an approximate length of 16 inches. Members 21–34 along with the legs, seat portion 16 and back portion 17 are provided in a kit in an unassembled condition allowing ready transportation of the kit and easy and quick assembly by the purchaser.

In the preferred embodiment, seat portion 16 and back portion 17 are produced from leather and are sewn together by laces similar to shoe lacing thereby not requiring of the assembler the normal upholstery skills required during the manufacture of a chair.

Figure 3:
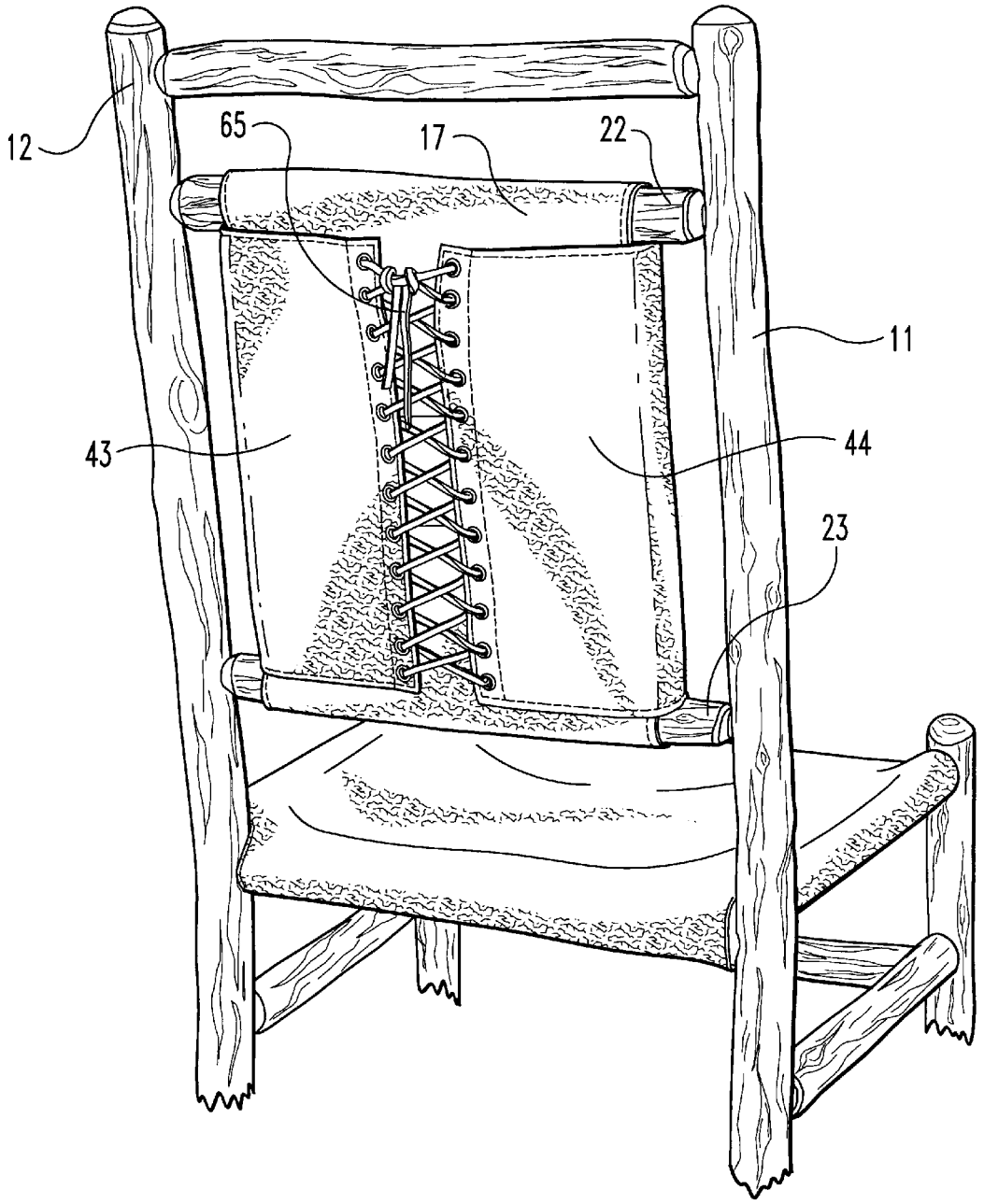
FIG. 3 is a fragmented rear view of the chair of FIG. 2 depicting the assembly of the back to the frame.
Figure 4:
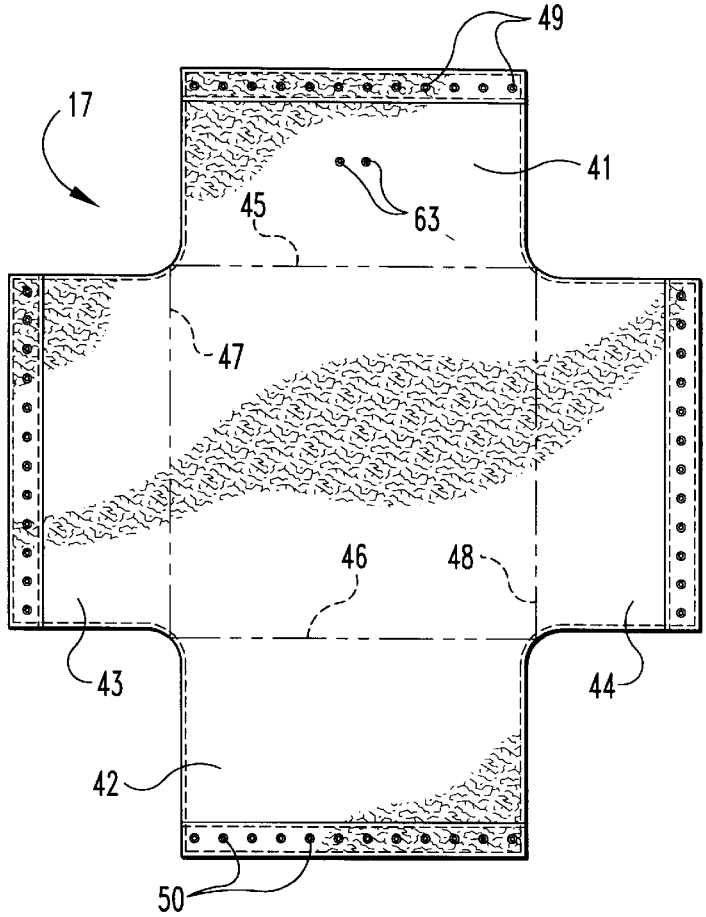
FIG. 4 is a plan view of back portion 17 in an unassembled condition.

Prior to assembly, back portion 17 has a cross shaped configuration with an upper flap 41 (FIG. 4) and a lower flap 42 along with slide flaps 43 and 44. Flaps 41–44 are folded inwardly along respectively crease lines 45–47 and are then secured together by lacing. Flaps 41 and 42 are first folded inwardly extending around cross members 22 and 23 (FIG. 3) with a single lace or a pair of laces then extending alternatively through holes 49 and 50 in shoe-lace fashion securing the distal ends of flaps 41 and 42 together in adjacent fashion.

Figure 6:
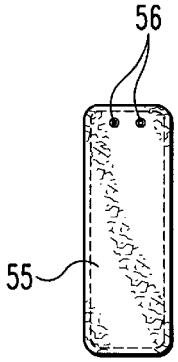
FIG. 6 is a plan view of the tongue sheet attached to top flap 41.
Figure 5:
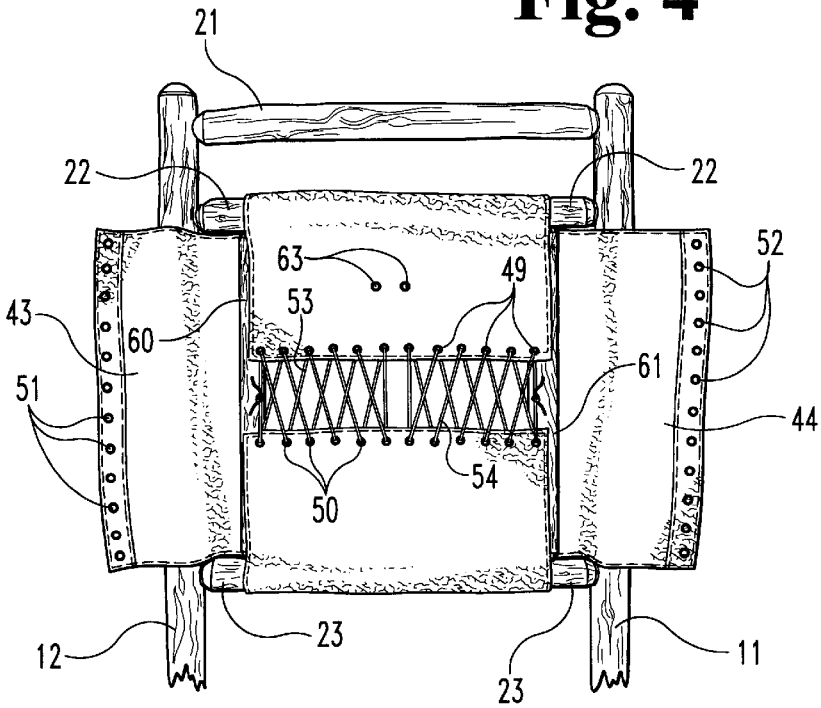
FIG. 5 is a rear view of chair of FIG. 3 illustrating flaps 41 and 42 secured together while flaps 43 and 44 have yet to be secured.

Referring to FIG. 5, a pair of laces 53 and 54 extend alternatively through holes 49 and 50 securing the distal ends of flaps 41 and 42 together. The flaps are secured together in a tighter fashion if a pair of laces are used. In such a case, lace 53 is inserted through holes 49 and 50 starting at the center of the two flaps and working to the outer left end as depicted in FIG. 5 whereas the second lace 54 is extended through holes 49 and 50 again starting in the center of the flaps and working to the right edge of the flaps as viewed in FIG. 5. The free ends of the two laces are then secured in the typical bow or knot configuration. A single sheet of leather 55 having an elongated or tongue shape includes a pair of apertures 56 (FIG. 6) with a third lace then extending through apertures 56 and apertures 63 of top flap 41 with sheet 55 extending downwardly over the top of laces 53 and 54 thereby concealing the center portion of the laces. Flaps 43 and 44 are then folded inwardly around cross members 60 and 61. Cross members 60 and 61 are included within the set of poles 15 and have reduced diameter ends that are received within the mutually opposing sockets of cross-members 22 and 23. Flaps 43 and 44 extend outwardly of and adjacent flaps 41 and 42 with tongue shaped sheet 55 being located between side flaps 43 and 44 and flaps 41 and 42. Thus, if the mutually opposed distal ends of side flaps 43 and 44 do not contact each other then tongue sheet 55 will conceal the inner laces 53 and 54. A single lace 65 may be used to extend through holes 51 and 52 to secure the flaps together.

Figure 8:
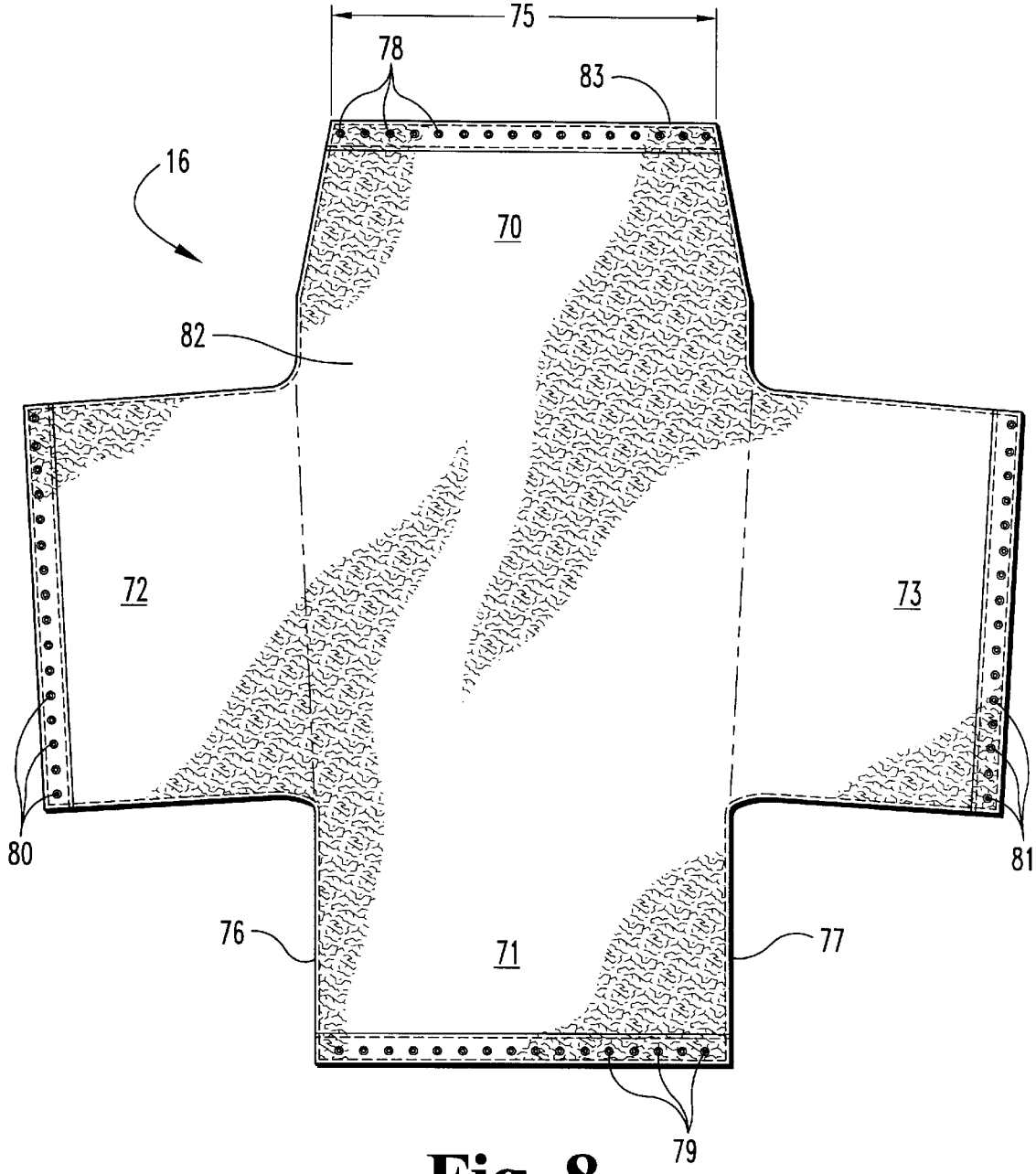
FIG. 8 is a plan view of seat portion in the extended and unassembled condition.

In the preferred embodiment, seat portion 16 has a front flap 70, a rear flap 71 and two side flaps 72 and 73 joined together in a cross configuration. The front flap 70 is tapered and has a distal end with a width 75 (FIG. 8) equal to the width of rear flap 71 that has a pair of parallel side edges 76 and 77. The two side flaps 72 and 73 extend away from the center of seat portion 16 in a direction from front flap 70 to rear flap 71. A plurality of holes 78–81 extend respectively through the distal ends of flaps 70–73. Since front flap 70 is tapered, it has a wider proximal end portion 82 as compared to its distal end portion 83. The taper of seat portion 16 is required since the front of the chair is wider as compared to the rear of the chair.

Figure 7:
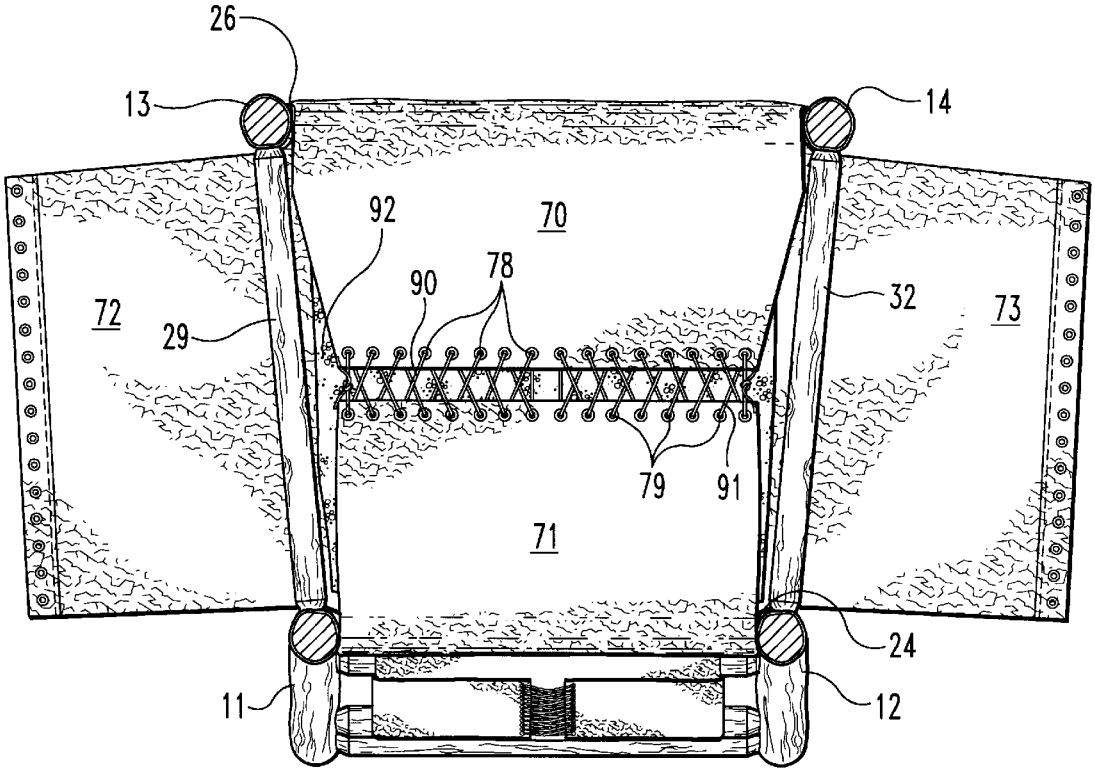
FIG. 7 is a bottom view of the seat portion taken along the line 7—7 of FIG. 2 and viewed in the direction of the arrows only showing flaps 70 and 71 secured together while flaps 72 and 73 are yet to be secured together.

In order to assemble seat portion 16 to the wood frame, the leather sheet is positioned atop cross members 24, 26, 29 and 32 with the flaps hanging downward. A foam rubber sheet 92 forming a cushion is inserted between cross members 24, 26, 29 and 32 and are enclosed by flaps 70 and 71. Front flap 70 is extended around cross-member 26 whereas rear flap 71 is extended around cross-member 24 with a single or a pair of laces then extending alternatively through holes 78 and 79 to secure the distal ends of flaps 70 and 71 together. In the embodiment of FIG. 7, a pair of laces 90 and 91 are extended alternatively through aperture 78 and 79 pulling flaps 70 and 71 together. Next, flaps 72 and 73 are folded over respectively members 29 and 32 and on top of flaps 70 and 71 with a pair of laces extending alternatively through holes 80 and 81 securing flaps 72 and 73 together. Flaps 72 and 73 are shown in the extended position in FIG. 7 in order to more clearly illustrate the configuration of flaps 70 and 71 and the positioning of the cushion 92.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A kit for making a chair comprising:

a plurality of wooden members having sockets and reduced diameter ends to fixedly fasten in said sockets to fit together forming legs, arms, a back support portion and a seat support portion for the chair;

a first flexible cross-shaped sheet having a first pair of oppositely directed and mutually facing extensions forming a first portion and a second portion and a second pair of opposite directed and mutually facing extensions transverse to said first pair, said first pair and said second pair are mountable to and are extendable around certain of said wooden members;

a first lace to extend through said first pair to draw together said first pair of extensions, said first portion has a first row of holes and said second portion has a second row of holes, said first lace is extendable alternatively through a hole in said first row and then through a hole in said second row in shoe-lace fashion;

a second lace to extend through said second pair to draw together said second pair of extensions; and, a flexible cushion enclosable by said first flexible cross-shaped sheet and cooperatively therewith forming a seat for the chair.

2. The kit of claim 1 and further comprising:

a second flexible cross-shaped sheet having a third pair of oppositely directed extensions and a fourth pair of opposite directed extensions transverse to said third pair, said third pair and said fourth pair are mountable to and are extendable around certain of said wooden members, said first flexible cross-shaped sheet being mountable to said seat support portion and said second flexible cross-shaped sheet being mountable to said back support portion;

a third lace to extend through said third pair to draw together said third pair of extensions; and, a fourth lace to extend through said fourth pair to draw together said fourth pair of extensions.

3. The kit of claim 2 wherein:

said third pair of oppositely directed extensions have vertically extending edge portions and said fourth pair of oppositely directed extensions have horizontally extending edge portions positioned inwardly of said vertically extending edge portions when laced together; and further comprising:

a tongue-shaped sheet having a top end fixedly attachable to one of said fourth pair of oppositely directed extensions and positionable between said third pair and said fourth pair, said tongue-shaped sheet extendable lengthwise adjacent said vertically extending edge portions concealing said fourth lace securing said horizontally extending edge portions together.

4. The kit of claim 3 wherein:

said wooden members include two horizontally extending wooden members and two vertically extending wooden members to form said back support portion with said said third pair of oppositely directed extensions mountable to and extendable around said two vertically extending wooden members and said fourth pair of oppositely directed extensions mountable to and extendable around said two horizontally extending wooden members.

5. The kit of claim 4 wherein:

said wooden members include a first set of wooden members and a second set of wooden members extendable perpendicular to said first set of wooden members to form said seat support portion with said first pair of oppositely directed extensions mountable to and extendable around said first set of wooden members and said second pair of oppositely directed extensions mountable to and extendable around said second set of wooden members.

6. The kit of claim 5 wherein:

said tongue-shaped sheet, said first flexible cross-shaped sheet and said second flexible cross-shaped sheet are leather.

7. A chair comprising:

a plurality of wooden poles connected together forming a chair having a seat and a back;

a first leather sheet mounted to said poles with said sheet having a first pair of opposite ends;

a first lace extending through and fastening together said ends securing said leather sheet to said poles;

said sheet has a second pair of opposite ends;

a second lace extending through and fastening together said second pair of opposite ends securing said leather sheet to said poles; and further comprising, a second leather sheet mounted to said poles forming said seat and having a first set of opposite ends;

a third lace extending through and fastening together said first set of opposite ends securing said second leather sheet to said poles;

said first leather sheet has a second pair of opposite ends;

a second lace extending through and fastening together said second pair of opposite ends securing said first leather sheet to said poles;

said wooden poles include two vertically extending wooden poles and two horizontally extending wooden poles forming cooperatively with said first leather sheet said back, said first leather sheet includes first portions extending around and mounted to said two vertically extending wooden poles and further includes second portions extending around and mounted to said two horizontally extending wooden poles, said wooden poles include a pair of wooden poles and two additional wooden poles arranged perpendicularly to said pair of wooden poles forming cooperatively with said second leather sheet said seat, said second leather sheet includes third portions extending around and mounted to said pair of wooden poles and further includes fourth portions extending around and mounted to said two additional wooden poles;

a cushion enclosed on all sides by said second leather sheet with said cushion positioned entirely between said pair of wooden poles and said two additional wooden poles.

8. A kit for making a chair comprising:

a plurality of separate wooden members forming legs, arms, a back support portion and a seat support portion for the chair, said seat support portion including a first pair of side cross members, a front cross member and a back cross member a flexible sheet having a main portion with a first pair of oppositely directed flaps extending outwardly from said main portion and extending around said cross members and then back beneath said main portion, said main portion further having a second pair of oppositely directed flaps transverse to said first pair and extending outwardly from said main portion and extending around said front cross member and said back cross member and then back beneath said main portion, said first pair of flaps having first distal end portions extending toward each other and said second pair of flaps having second distal end portions extending toward each other;

a first lace to extend through said first distal end portions to draw together said first pair of flaps; and, a second lace to extend through said second distal end portions to draw together said second pair of flaps.

9. The of claim 8 further comprising:

a flexible cushion enclosable by said flexible sheet and cooperatively therewith forming a seat for the chair.

10. A chair comprising:

a plurality of wooden poles connected together forming a chair having a seat frame and a back, said poles including side cross members, and front and back cross members connected together forming said seat frame, said;

a leather sheet mounted to said seat frame with said sheet having a first pair of flaps with first distal ends extending around said side cross members and a second pair of flaps extending transverse relative to said first pair of flaps and having second distal ends extending around said front and back cross members;

a first lace extending through and fastening together said first distal ends securing said leather sheet to said side cross members; and, a second lace extending through and fastening together said second distal ends securing said leather sheet to said front and back cross members.

11. The chair of claim 10 and further comprising:

a cushion enclosed by said sheet with said cushion positioned entirely between said side cross members and said front and back cross members.

* * * * *